US008096022B2

(12) United States Patent
Hui

(10) Patent No.: US 8,096,022 B2
(45) Date of Patent: Jan. 17, 2012

(54) RECLOSABLE CONTAINER AND METHOD OF MANUFACTURE

(75) Inventor: Jonathan Hui, Hong Kong (CN)

(73) Assignee: Global Packaging Solutions Limited, Kowloon Bay (HK)

( * ) Notice: Subject to any disclaimer, the term of this patent is extended or adjusted under 35 U.S.C. 154(b) by 130 days.

(21) Appl. No.: 11/263,607

(22) Filed: Oct. 31, 2005

(65) Prior Publication Data

US 2007/0094850 A1 May 3, 2007

(51) Int. Cl.
*A44B 19/36* (2006.01)

(52) U.S. Cl. ..... 24/30.5 R; 24/400; 383/64

(58) Field of Classification Search ..... 24/400, 24/399, 30.5 R; 383/61.3, 64, 61.2, 63
See application file for complete search history.

(56) References Cited

U.S. PATENT DOCUMENTS 3,054,434 A 9/1962 Ausnit
3,230,593 A 1/1966 Herz
3,122,807 A 3/1966 Ausnit
3,338,284 A 8/1967 Ausnit
3,852,386 A 12/1974 Behr
4,262,395 A * 4/1981 Kosky ..... 24/400
4,620,320 A 10/1986 Sullivan
4,663,915 A 5/1987 Van Erden et al.
4,710,968 A 12/1987 Borchardt et al.
4,778,282 A 10/1988 Borchardt et al.
4,846,585 A 7/1989 Boeckmann et al.
5,007,143 A 4/1991 Herrington
5,048,692 A 9/1991 Handler et al.
5,067,208 A 11/1991 Herrington et al.
5,131,121 A 7/1992 Herrington, Jr. et al.
5,272,794 A 12/1993 Hamatani et al.
5,301,395 A 4/1994 Richardson et al.
5,351,369 A 10/1994 Swain
5,442,837 A 8/1995 Morgan
5,482,375 A 1/1996 Richardson
5,647,100 A 7/1997 Porchia et al.
5,664,296 A 9/1997 May
5,664,299 A 9/1997 Porchia
5,689,866 A 11/1997 Kasai et al.
5,871,281 A 2/1999 Stolmeier et al.
5,924,173 A 7/1999 Dobreski et al.
5,950,285 A * 9/1999 Porchia et al. ..... 24/400
5,956,924 A * 9/1999 Thieman ..... 53/412
(Continued)

*Primary Examiner* — James Brittain

(57) ABSTRACT

The present invention includes a reclosable bag having first and second walls and an open top defined by first and second elongate flexible fastener strips adjacent the top of the walls. One of the fastener strip has a profile portion forming a groove and had a profile portion forming a rib. A portion of the rib is received and retained in the groove when the bag top is closed. Each of the fastener strips has a base connected to the respective walls and each of the fastener strips further has an upper edge adjacent the upper edge. The bag has a slider mounted on the strips and movable in one direction longitudinally to progressively separate the rib from the groove to open the bag, and the slider is movable in the opposite direction to progressively return the rib to a retained condition in the groove so as to close the bag. A separator, located in the slider, is attached to the top of the slider and extends downwardly therefrom and has a disproportion residing in the space between the top of the slider and the upper edges of the fastener strips when the rib is retained in the groove of the first profile. The separator has an arrow shaped tip having an angle of 60°±30° constructed and arranged to facilitate separation of the rib from the groove.

13 Claims, 9 Drawing Sheets

U.S. PATENT DOCUMENTS 6,000,197 A 12/1999 Ausnit
6,088,887 A 7/2000 Bois
6,178,722 B1 1/2001 McMahon
6,292,986 B1 9/2001 Provan
6,305,844 B1 10/2001 Bois
6,461,042 B1 * 10/2002 Tomic et al. ..... 383/64
6,470,551 B1 10/2002 Provan et al.
6,477,820 B1 11/2002 Dutra et al.
6,562,165 B1 5/2003 Bauman et al.
6,571,430 B1 6/2003 Savicki et al.
6,575,628 B1 * 6/2003 Borchardt et al. ..... 383/64
6,576,278 B1 6/2003 Sprehe
6,581,249 B1 6/2003 Savicki et al.
6,582,122 B2 6/2003 Shimizu
6,594,872 B2 7/2003 Cisek
6,609,353 B1 8/2003 McMahon
6,609,827 B2 8/2003 Bois
6,622,353 B2 9/2003 Provan
6,632,021 B2 10/2003 Bois
6,691,383 B2 2/2004 Linton
6,692,147 B2 2/2004 Nelson
6,694,704 B1 2/2004 Ausnit
6,698,925 B2 3/2004 Bentsen
6,721,999 B2 4/2004 Meager
6,733,178 B2 5/2004 Bois
6,755,569 B2 6/2004 Bois
6,761,481 B1 7/2004 Bois
6,810,641 B2 11/2004 Ausnit
6,846,107 B2 1/2005 Sweeney et al.
6,854,886 B2 2/2005 Piechocki et al.
6,854,887 B2 2/2005 Anderson
6,860,952 B2 3/2005 Pawloski
6,862,866 B2 3/2005 Jacobsen et al.
6,901,637 B2 6/2005 Machacek
6,902,321 B2 6/2005 Bois
6,948,848 B2 9/2005 Ausnit
6,954,969 B1 10/2005 Sprehe
2002/0034342 A1 3/2002 Bois
2002/0152723 A1 10/2002 Ausnit
2002/0154837 A1 10/2002 Ausnit
2003/0101552 A1 6/2003 Plourde
2003/0177619 A1 9/2003 Cisek
2003/0217444 A1 * 11/2003 Blythe et al. ..... 24/399
2004/0000501 A1 1/2004 Shah et al.
2004/0001650 A1 1/2004 Piechocki
2004/0022460 A1 2/2004 Plourde
2004/0066984 A1 4/2004 Li
2004/0091179 A1 5/2004 Anderson
2004/0136618 A1 7/2004 Ausnit
2004/0161167 A1 8/2004 Ausnit
2004/0161178 A1 8/2004 Olechowski
2004/0165794 A1 8/2004 Plourde et al.
2004/0204303 A1 10/2004 Wright et al.
2004/0252915 A1 12/2004 Nelson
2005/0008266 A1 1/2005 Crunkleton et al.
2005/0008267 A1 1/2005 Linton et al.
2005/0025396 A1 2/2005 ErkenBrack
2005/0063620 A1 3/2005 Anderson
2005/0129338 A1 6/2005 Sprehe
2005/0137073 A1 6/2005 Weaver
2005/0141786 A1 6/2005 Piechocki
2005/0178691 A1 8/2005 Frenkil
2005/0207679 A1 9/2005 Armstrong
2005/0220371 A1 10/2005 Machacek

* cited by examiner

RECLOSABLE CONTAINER AND METHOD OF MANUFACTURE

BACKGROUND OF THE INVENTION

The present invention relates generally to improvements in flexible fasteners of the type having releasably interlocking rib and groove elements with a slider to interlock or separate the rib and groove elements. The invention relates specifically to slide fasteners formed along one edge of the reclosable bag. The slide fasteners have a pair of fastener strips running along the top of the bag integrally formed in the bag wall. One of the fastener strips has an arrowhead shaped profile extending perpendicularly from and transverse to the top of the bag. The other oppositely opposed fastener strip has a C-shaped profile sized, constructed and arranged for the arrowhead shaped profile.

A problem in the manufacture of slide fasteners for profile strips is to secure the slider to the profile strip, and to allow sealing of the fastener strip in an essentially leak-proof manner and to prevent removal of the slides from the bag.

Accordingly, it is an object of the present invention to manufacture slide fasteners in which the fasteners are easily opened, but are substantially leakproof when sealed.

It is an additional object of the invention to provide sliders or slide fasteners which are extremely difficult to remove from the bag, in order to provide a child safety feature.

It is a further object of the invention to provide slide fasteners in which the fasteners and the film for the bags can be co-extruded so as to simplify the manufacturing process and reduce costs.

The foregoing description of drawings merely explain and illustrate the invention and the invention is not limited thereto, except insofar as those who have the disclosure before them are able to make modifications and variations therein without departing from the invention.

DETAILED DESCRIPTION OF THE PREFERRED EMBODIMENT

Figure 1:
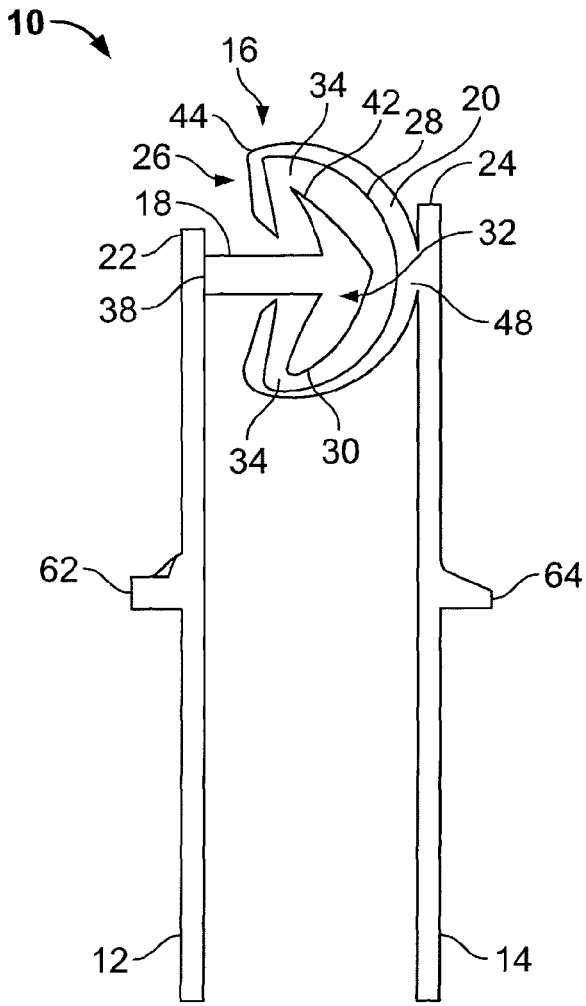
FIG. 1 of the drawings is a vertical section of the reclosable fastener profile of the present invention, partially broken away, showing male and female profiles, and guide ribs disposed on the outer walls of the reclosable bag.
Figure 2:
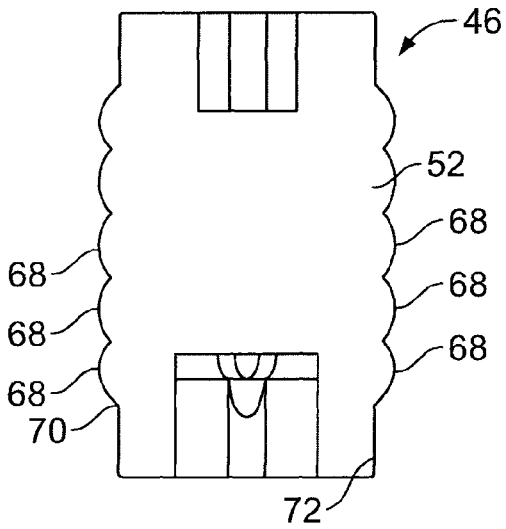
FIG. 2 of the drawings is a top view of the slider of the present invention.
Figure 3:
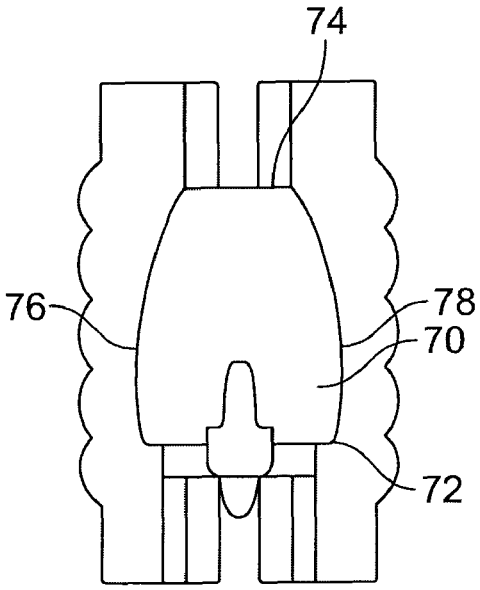
FIG. 3 of the drawings is a bottom view of the slider of the present invention.

As shown in FIG. 1 of the drawings, a reclosable bag 10 having first and second walls 12 and 14 and an open top 16 is defined by first and second elongate flexible strips 18 and 20 attached to the first and second walls 12 and 14, respectively, adjacent the top 22 and 24 of the walls. One of the fastener strips 20 has a profile portion 26 which forms a groove 28. The other fastener strip 18 has a profile portion 30 forming a rib 32 with a portion of the rib 34 received and retained within the groove 28 when the bag 36 is closed. Each of the strips 18 and 20 has a base 38 and 48 connected to the respective walls 22 and 24 and each of the strips 18 and 20 further has an upper edge 42 and 44 adjacent the upper edge of the other strip 18 and 20 respectively.

Figure 7:
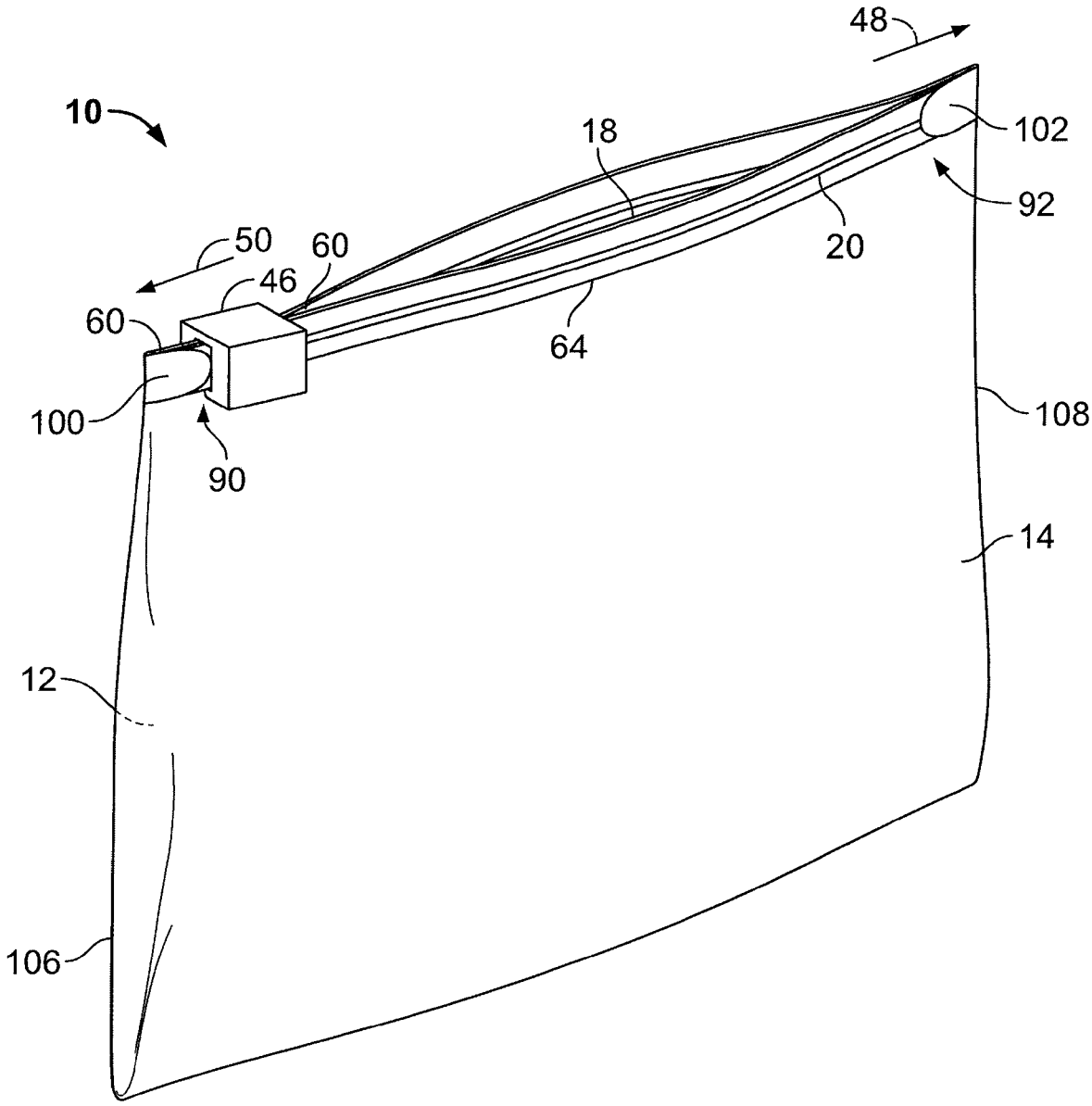
FIG. 7 of the drawings is a front perspective view of the reclosable container of FIG. 1.

As shown in FIG. 7, Bag 10 has a slider 46 mounted on the strips 18 and 20 and moveable in one direction 48 longitudinally of the strips 18 to 20 to progressively separate the rib 34 from the groove 28 to open the bag 10. Slider 46, being moveable in the opposite direction 50, progressively returns the rib 32 portion to retain condition in the groove 28 to close the bag.

As shown in FIGS. 1-6, the slider 46 further has a top 52. The slider 46 further has a separator 54 situated therein having a proximal portion 56 attached to the top 52 of the slider 46 and extending downwardly therefrom and having a distal portion 58 residing in a first space 60 between the top of the slider and the upper edges of the groove 28 when the rib portion 32 is retained in the groove 28 of the profile. The separator 54 has an arrow-shaped tip 60 constructed and arranged, i.e., positioned and sized to facilitate selective separation of the rib 32 from the groove 28.

In the preferred embodiment the separator has a length of 2.3 mm±0.3 mm. The separator 54 is preferably integrally formed from the slider 46 and is made of one homogeneous unit of plastic, preferably injection molded POM ocetel rock or that sold by RTP Company, Winona, Minn., or polypropylene with additive for lubrication.

In the preferred embodiment the slider is constructed of polyethylene, polycarbonate, polystyrene, acryl nitryl butyldirene styrene or other commonly formed injection molded plastic pieces.

As a further feature of the invention as shown in FIG. 1, the outside walls 12, 14 have a pair of flanges 62 and 64 or tracks extending outwardly therefrom and running parallel to the upper edges 22, 24 of the walls. The flanges 62 and 64 are sized for telescopic reception in slider 46, as will be further described herein. Flanges 62 and 64 are substantially rectangular in shape.

Figure 4:
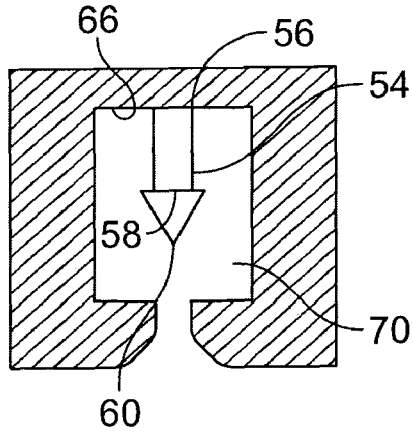
FIG. 4 of the drawings is a front cutaway view of the slider of FIGS. 2 and 3 showing a separator extending downwardly from the top surface thereof.

As seen in FIGS. 2-6, slider 46 has a top portion 52. Extending downwardly from top portion 52, as is seen in FIG. 4, is a separator 54 having a distal portion 58. The distal portion 58 of separator 54 has an arrowhead shaped tip 60 mounted thereon. The arrowhead has an angle of 60°±10° which is to facilitate opening of groove 28 of profile portion 26 with rib 32 profile portion 30 as contained therein.

In the preferred embodiment, top portion 52 of slider 46 is approximately 1.2 mm in thickness. The distal portion 58 extends approximately 2.3 mm from the inside surface 66 of top 52. Slider 46 preferably has a height of approximately 8.6 mm, a thickness at its ends of 1.15 mm, a length of 14.8 mm, and the arrowhead shaped tip 60 of a height of approximately 1 mm.

In the preferred embodiment, slider 46 has a series of gripping ribs 68 which were vertically disposed along its lateral edges 70 and 72, respectively. These gripping ribs 68 in the preferred embodiment have a radius of approximately 1.25 mm.

In the preferred embodiment, slider 46 has an interior chamber 70 having vertical walls at the front and rear ends 72 and 74, and having curved sidewalls 76 and 78 which have a radius of 9.9 mm.

Figure 5:
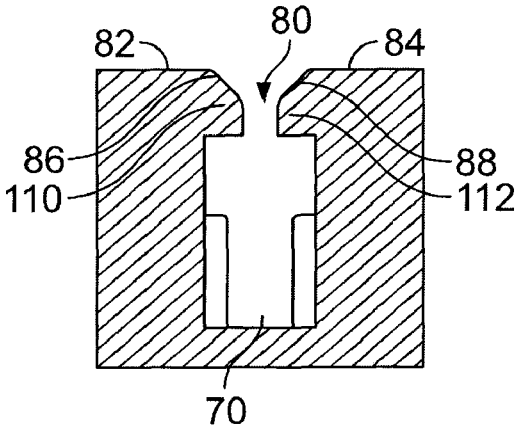
FIG. 5 of the drawings is a rear cutaway view of the slider of FIGS. 2-4.
Figure 6:
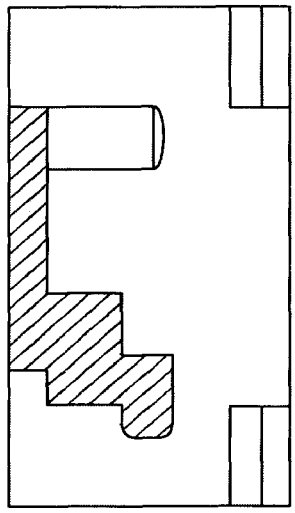
FIG. 6 of the drawings is a vertical section taken along the lines BB of FIG. 3 showing the internal configuration of the slider of FIGS. 2-5.

As best seen in FIG. 5, slider 46 has a centrally disposed gap 80. Gap 80 in the preferred embodiment is 1.15 mm in width. The left and right bottom surfaces 82 and 84 are approximately 2.5 mm in width having beveled surface 86 and 88. Beveled surfaces 86 and 88 are approximately 0.8 mm and are beveled at an angle of 45° relative to the left bottom surface 82 and right bottom surface 84. Gap 80 is designed to receive rib 32 and to retain rib 32 within chamber 70.

In addition, as seen in FIG. 7, chamber 70 is also designed to receive exterior flanges 62 and 64 which are retained within chamber 70 so as to retain slider 46 on fastener strips 18 and 20. In the preferred embodiment, a force of at least three pounds and preferably 5 pounds is required to remove slider 46 from fastener strips 18 and 20.

As further seen in FIG. 7, slider 46 has a first travel and stop position 90 where the bag 10 is in the closed position and the fastener strips 18 and 10 are interlocked and a second travel and stop position 92 in which fastener strips 18 and 20 are separated from each other to allow dispensing of product from bag 10 or insertion of product therein.

As further seen in FIG. 7, the proximal and distal ends 100 and 102 are fastener strips 18 and 20 and are ultrasonically sealed to each other and to bag walls 12 and 14, proximate the lateral edges 106 and 108 of bag 10. The ultrasonic seal is to prevent the fastener strips 18 and 20 from opening, and to prevent the bag 10 from being torn when the fastener strips 18 and 20 are open.

Returning to FIG. 4, within slider 46 are inwardly facing channels 108 and 110 which are sized and positioned for slidable reception of flanges 62 and 64 and for retention of flanges 62 and 64 in slot or gap 82. On the bottom of slider 46 are a pair of inwardly facing shoulder members 110 and 112 with gap 80 therebetween. Shoulder members 110 and 112 have beveled surfaces 86 and 88 thereon for guiding fastener strips 18 and 20 into said gap 82.

Figure 8:
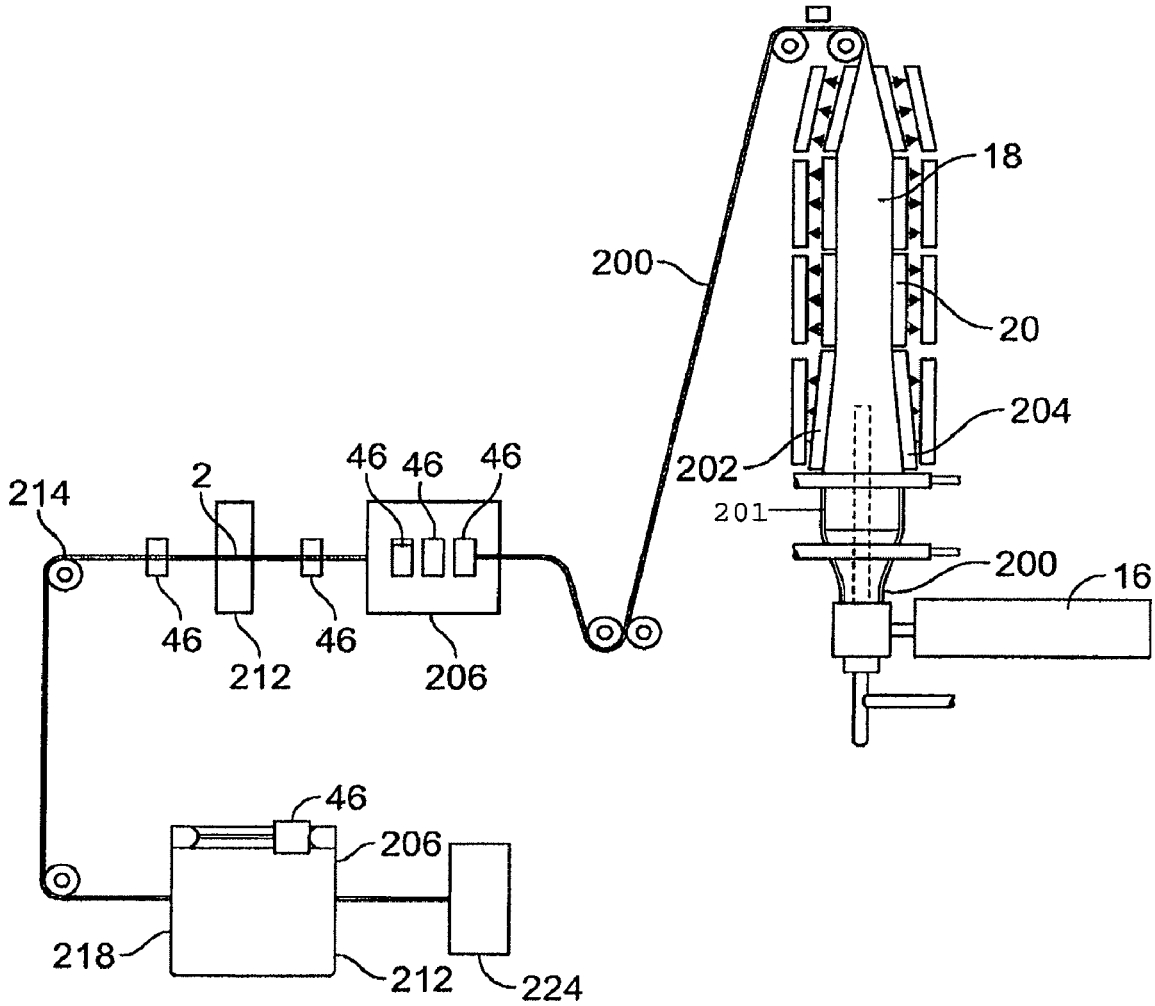
FIG. 8 of the drawings is a front view of the apparatus for extruding thermoplastic film having fastener profiles integrally formed therein.

The present invention further includes a method of manufacture of reclosable bags. As seen in FIG. 8, the length of thermoplastic film 200 is extruded as a tube 201. Tube 201 is slit between male and female profiles 26 and 30 so as to form opposed longitudinal edges 202 and 204. Simultaneously, a pair of fastener strips 18 and 20 are extruded on longitudinal edges 202 and 204, respectively, as well as flange 62 and 74. Film 200 is preferably a low density polyethylene such as Exion 316 having a thickness of 4 mm. Film 200 may also be laminated to other materials such as foil, nylon, or other commonly known laminating materials.

Film 200 and fastener strips 18 and 20 are cooled by being passed through a cooling tower 208, as shown in FIG. 8 and as is known by one of ordinary skill in the art. Sliders, such as slider 46, may be applied at spaced intervals to fastener strips 18 and 20 by slider dispenser 206. Each of the fastener strips has either a male or female profile for interlocking with the other. Once the sliders attach to the fastener strips, the film 200 is cross-sealed at location 212 to form the first side 206 of a bag 10. A second cross-seal 214 is sealed on a bag tube 216 to form a second side 218 of bag 10, so as to capture a single slider 46 between the first and second sides 206 and 218 of bag 210. A spot seal 219 such as those found by an ultrasonic sealing may be used to seal the ends 100 and 102 of the fastener strips 18 and 20 on each bag 14 (FIG. 7).

Bag 210 is then cut from the film tube 216 by means of a hot wire or knife 224. A finished bag 10 is thus provided with a reclosable fastener 230 and a slider 46 for opening and closing the bag 210.

Figure 13:
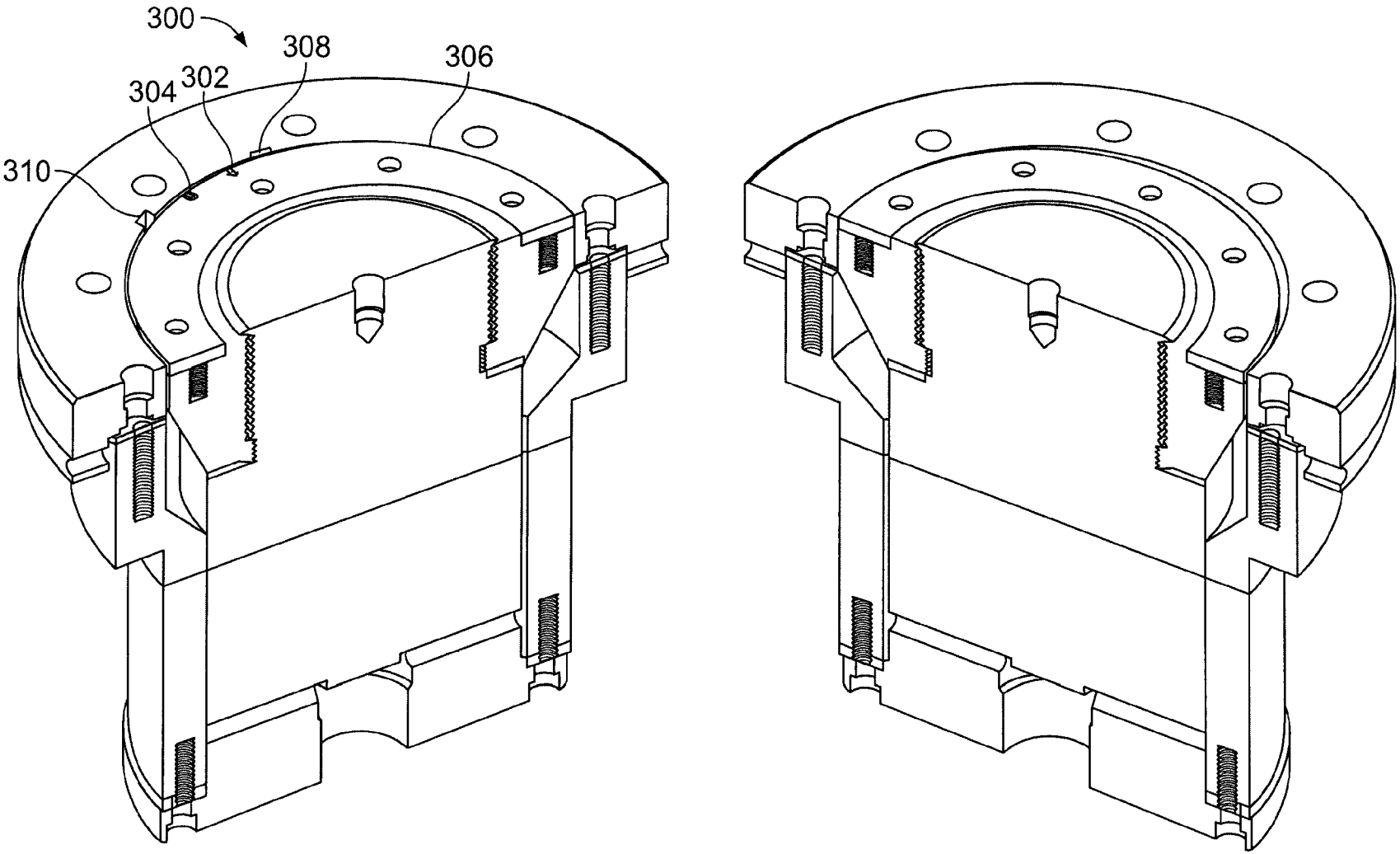
FIG. 13 of the drawings is a vertical section of an extrusion die in an exploded view separated into two parts used for manufacturing a tube of thermoplastic film having reclosable fastener profile strips integrally formed thereon and tracks on the exterior of the film.
Figure 14:
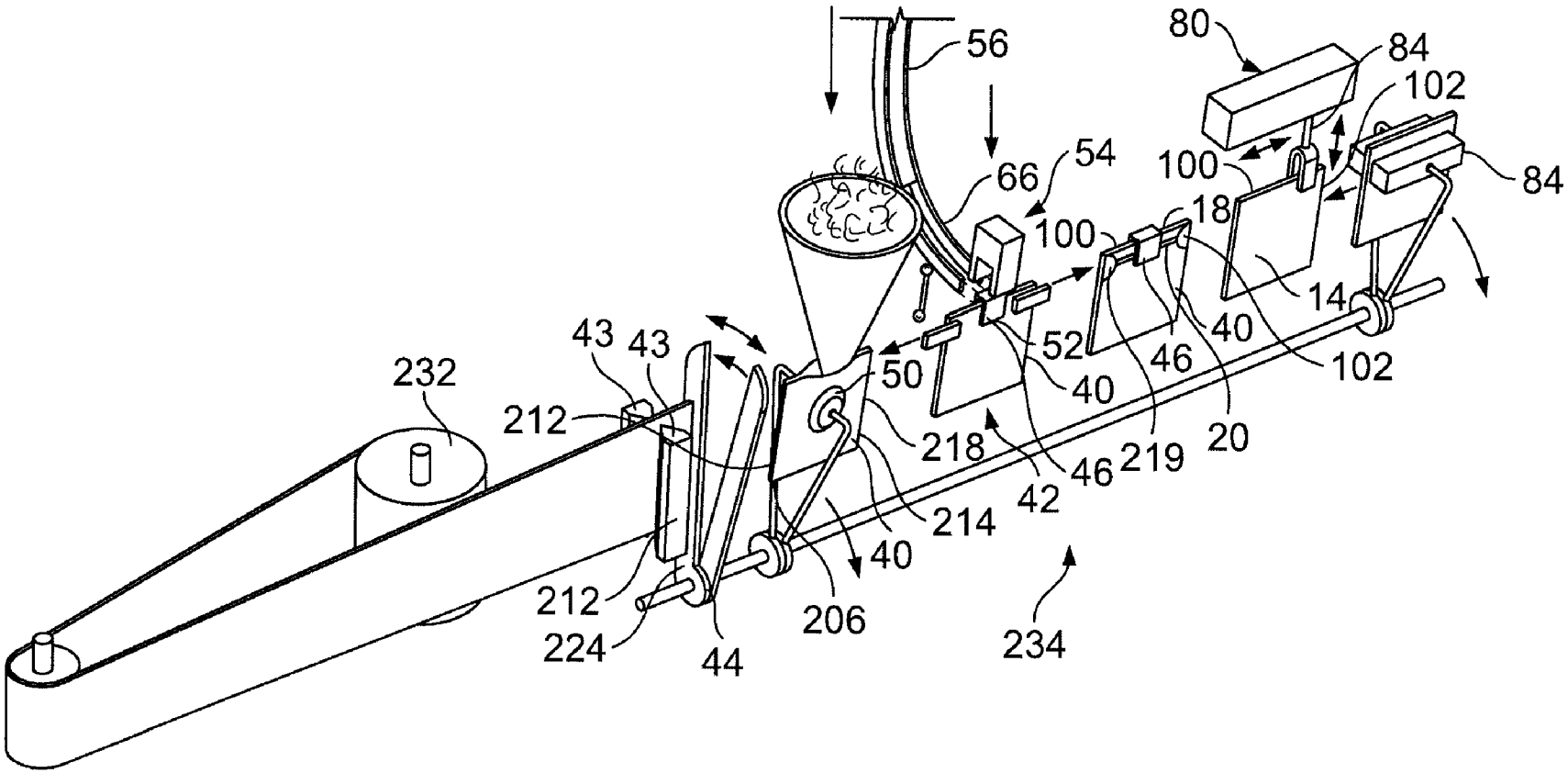
FIG. 14 of the drawings is a schematic diagram showing converting of the plastic film manufactured in FIG. 8 into reclosable bags utilizing a conventional bag making machine having a slider application device thereon.
Figure 15:
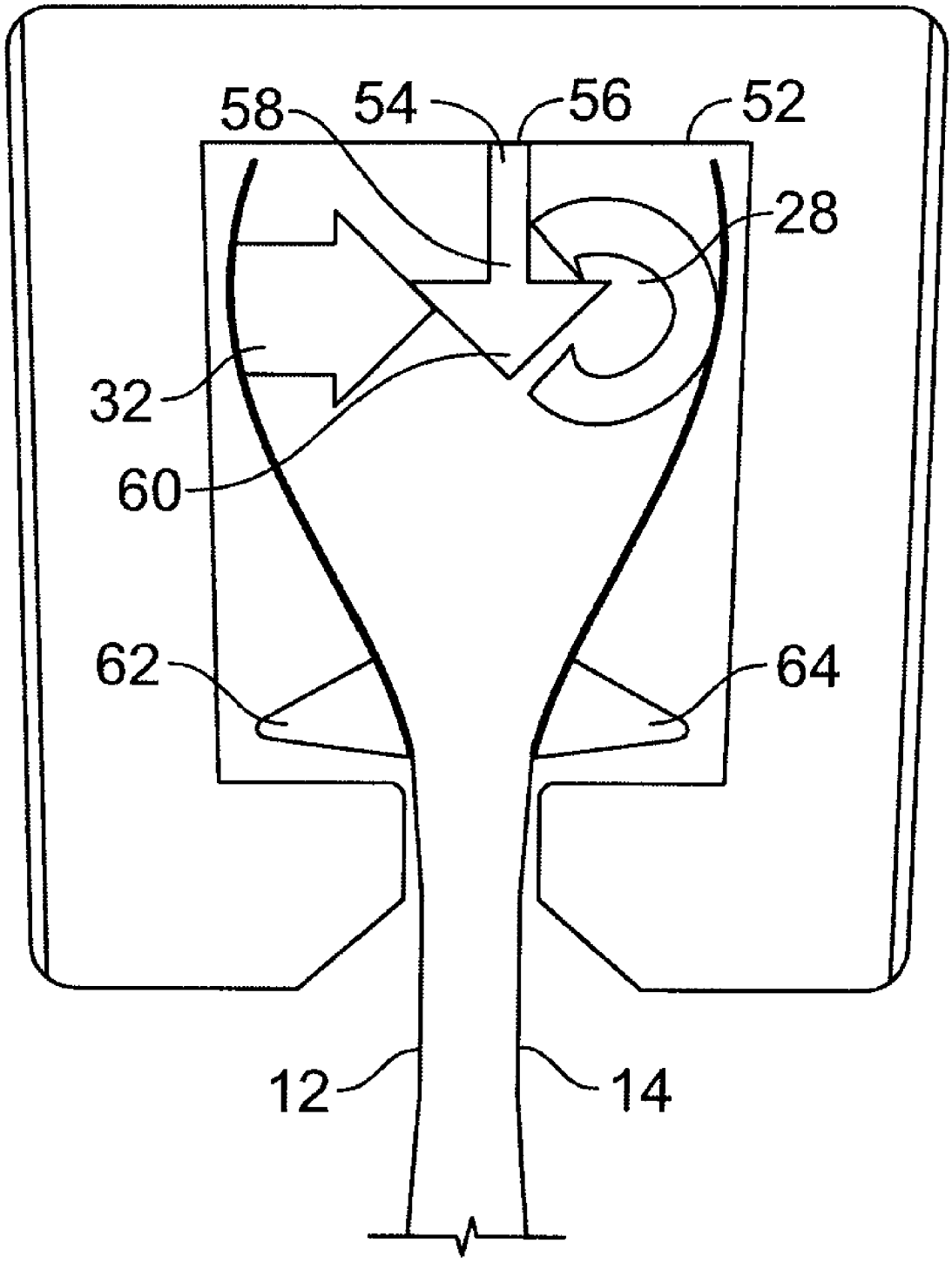
FIG. 15 of the drawings is a vertical section of the male and female profiles of FIG. 1 extending from the bag walls with the slider disposed on the fastener, as well as the separator having a proximal portion attached to the slider and having a distal portion residing in the groove of the female profile.

Alternatively, as seen in FIG. 13, tube 201 may be cooled and then wound onto a roll 232. Roll 232 may then be shipped to the user who has a bag making machine 234. Roll 232 may then be intermittently unwound from roll 232 and sliders 46 applied at spaced intervals. Cross seals 212 may then be formed across bag tube 216. A second cross-seal 214 is sealed on a bag tube 216 to form a second side 218 of bag 10, so as to capture a single slider 46 between the first and second sides 206 and 218 of bag 210. A spot seal 219 such as those found by an ultrasonic sealing may be used to seal the ends 100 and 102 of the fastener strips 18 and 20 on each bag 14 (FIG. 7).

Bag 210 is then cut from the film tube 216 by means of a hot wire or knife 224. A finished bag 10 is thus provided with a reclosable fastener 230 and a slider 46 for opening and closing the bag 210.

Figure 9:
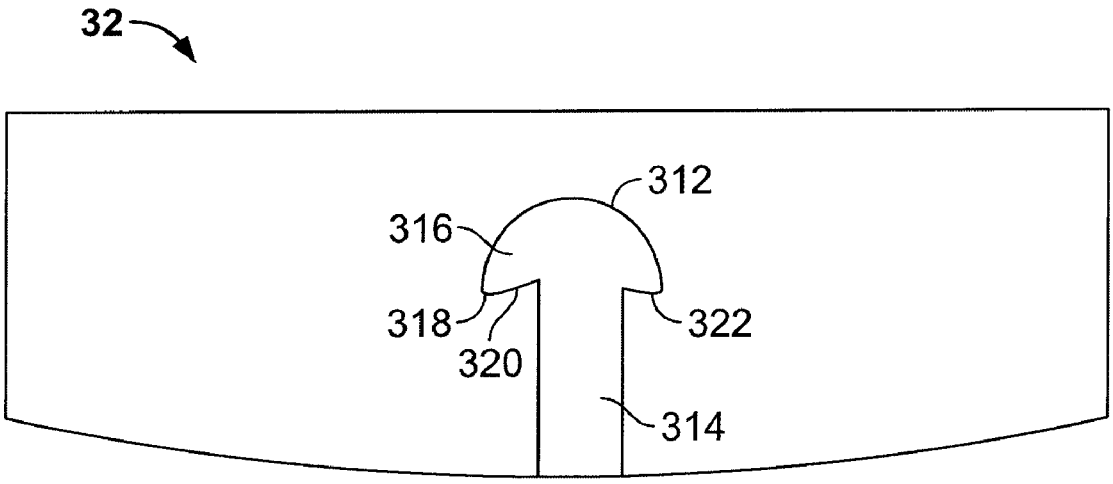
FIG. 9 of the drawings is a front perspective view of a portion of the die used for manufacturing a male profile in the fastener strips of FIG. 1.
Figure 10:
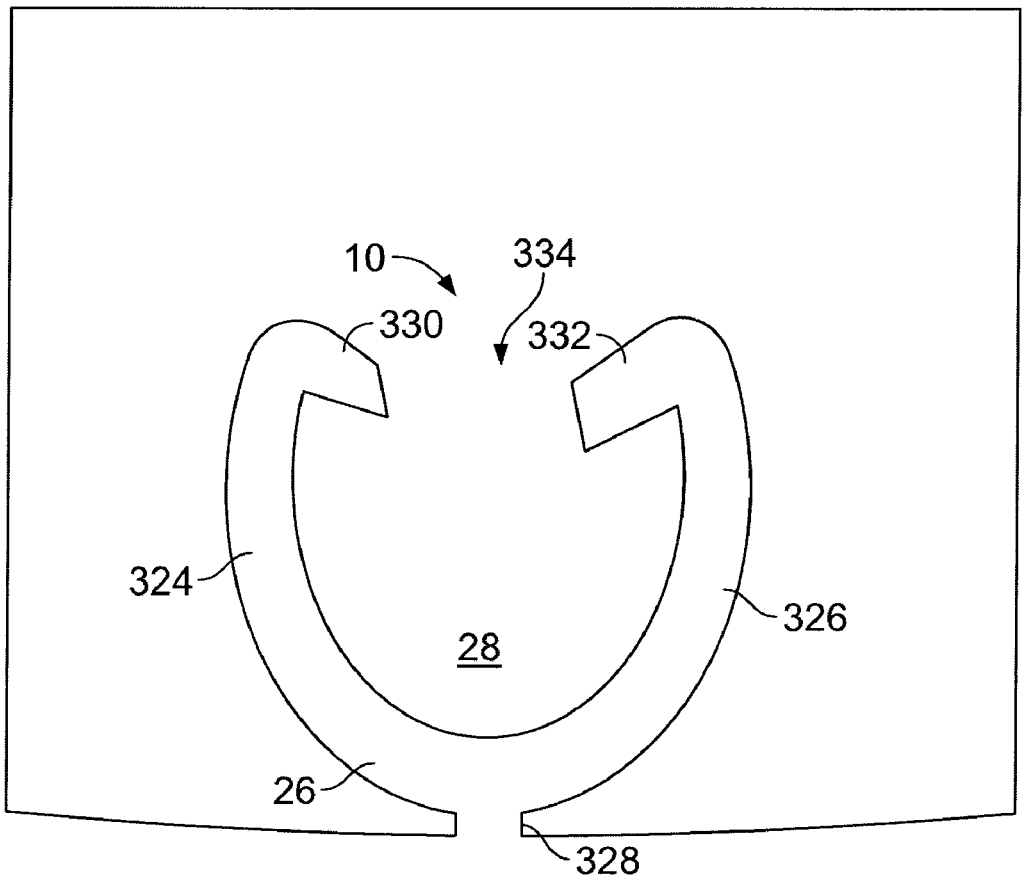
FIG. 10 of the drawings is a front perspective view of one portion of the die used to show the female fastener strips in FIG. 1 of the drawings.

As seen in FIG. 13 of the drawings, an extrusion die 300 for blown film (not shown) is shown in a split configuration, but as is known by those in the art, the die would be formed as a circular tube through which thermoplastic, such as polyethylene, film is extruded. As further seen in FIG. 13, a gap or first aperture 302 for forming a rib 32 in the configuration shown in FIG. 9 is disclosed. A second aperture 304 is formed in die 300 in the configuration of the female profile or groove 28 as best seen in FIG. 10. Molten thermoplastic film (not shown) is extruded through die opening 306 so as to form a tube of film which solidifies upon exposure to the air and is cooled to form a tube of plastic film as described infra relative to FIG. 8. On either side of first aperture 302 and second aperture 304 are third and fourth apertures 308 and 310 formed in a configuration of flanges or tracks 62 and 64, best seen in FIG. 1. Thus, when film is extruded from die 300, flanges 62 and 64 are formed on the outside of the film which later forms the bag walls 12 and 14. Male profile 18 and female profile 24 are formed on the inside of bag walls 12 and 14. This simultaneous extrusion of both the fasteners and the flanges facilitates manufacturing speed, reduces cost, and produces a uniform quality product.

As seen in FIG. 9 of the drawings, first aperture 302 of die 300 has a height of 8.5 centimeters and a mushroom shaped configuration. The mushroom shaped head 312 of the mushroom is approximately 2.5 centimeters in thickness, and the width of the shaft 314 is approximately 1.5 centimeters on the right side and approximately 1 centimeter on the left side. In order to make it more difficult for bag 10 to be opened by the force of product within the bag, fastener 18 is constructed to provide what is called differential opening force, i.e., the force required to open from the outside of the bag is easier than that required from the inside of the bag. In this regard, mushroom shaped head 312 has a larger portion 316 having a lip or rim 318 having a barb or hook shape 320 which is at a greater angle and, therefore, more difficult to open than the less angled barb 322 on the opposite side of the mushroom shaped head 312. In the preferred embodiment, mushroom shaped head 312 has a radius of 2.8 centimeters.

Similarly, as shown in FIG. 10, profile portion 26 has a groove 28. Groove 28 is formed from a pair of arms 324 and 326 which extend upwardly from base 328. Corresponding apertures in mold 304 are shown in FIG. 10. In the preferred embodiment groove 28 has a pair of barbed members 330 and 332 extending inwardly and downwardly with a gap 334 extending therebetween sized for reception of male profile 32. Barbs 330 and 332 are sized, constructed and arranged for interlocking with hooks 318 and 322 when male profile 32 is telescopically inserted into groove 28. Groove 28 and fastener 10 must be sufficiently flexible to allow barbs 318 and 322 as well as fastener 32 to be inserted therein. Consequently, arms 324 and 328 are sufficiently flexible to allow such insertion, but are sufficiently stiff to retain male fastener profile 32 within groove 28 when interlocked with barbs 330 and 332. Similarly, when it is decided to remove male fastener 32 from groove 28, arms 324 and 326 are sufficiently flexible to allow such removal. It should be noted in this regard that barb 32 is larger in size and has a greater downward angle than barb 330 so as to make it more difficult for product within bag 10 to force fastener 16 open.

Figure 11:
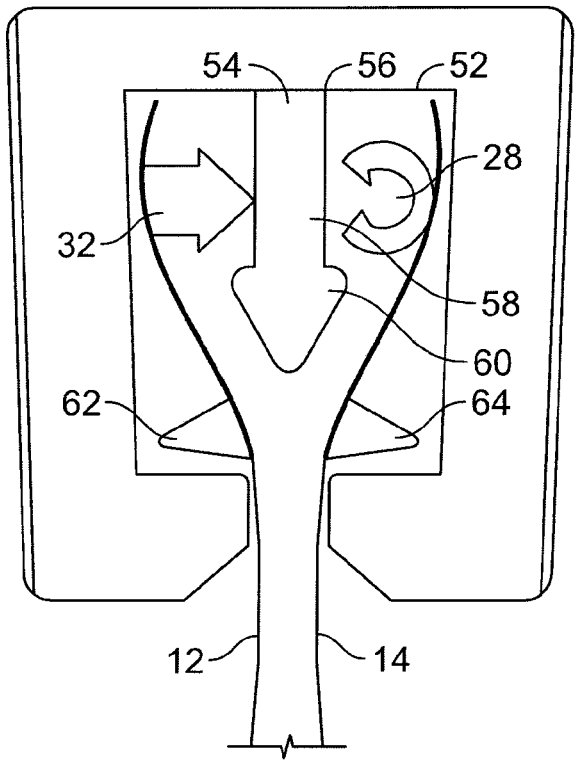
FIG. 11 of the drawings is a vertical section of the male and female profiles of FIG. 1 extending from the bag walls, with the slider disposed on the fastener and held in place by the bottom track extending laterally from the bag walls, as well as the separator extending between the male and female profiles.
Figure 12:
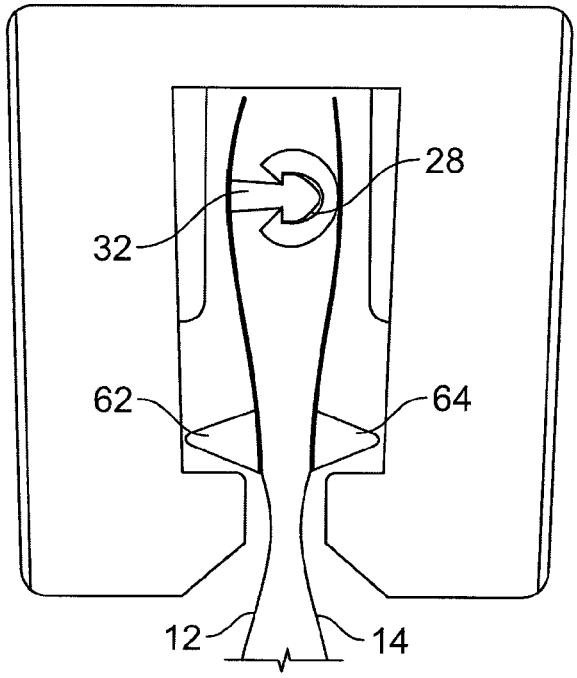
FIG. 12 of the drawings is a vertical section of the bag and fastener strip of FIG. 11 showing in particular the male and female profiles interlocked and the slider affixed to the fastener strip by the bottom tracks.

As best seen in FIGS. 11 and 12 of the drawings, tracks or flanges 62 and 64 are formed on the exterior walls of 12 and 14 of bag 10. Bag 10, of course, is formed from the previously mentioned tube of thermoplastic film which is extruded through die 300. As further seen in FIG. 11, separator 54 has a length of 2.3 millimeters ±0.3 millimeters. Slider 46 has its proximal portion 56 of separator 54 attached to the top 52 of the interior surface of the slider 46 and has a distal portion 58 residing in a first space 60 within slider 46.

I claim:

1. In a reclosable bag having first and second walls and an open top defined by first and second elongate flexible fastener strips attached to the first and second walls, respectively, adjacent the top of the walls, one of the fastener strips having a profile portion forming a groove and the other fastener strip having a profile portion forming a rib with a portion of the rib received and retained in the groove when the bag top is closed, each of the fastener strips having a base connected to the respective wall, and each of the strips having an upper edge adjacent the upper edge of the other strip, and the bag having a slider mounted on the fastener strips and movable in one direction longitudinally of the fastener strips to progressively separate the rib from the groove to open the bag, and the slider being movable in the opposite direction to progressively return the rib portion to a retained condition in the groove to close the bag, comprising:

a separator situated in the slider and having a proximal portion attached to the top of the slider and extending downwardly therefrom and having a distal portion residing in a first space between the top of the slider and the upper edges of the fastener strip when the rib portion is retained in the groove of the groove-forming profile;

said separator having an arrowhead-shaped tip having an angle of 60°±30° in a triangular shape constructed and arranged to facilitate selective separation of said rib from said groove; and each of the first and second walls has a substantially rectangular flange turned outwardly from the wall and running parallel to and substantially spaced apart from the said top of the walls thereof and substantially below the elongated fastener strips and top of the walls, said flange being operatively associated with the slider allowing the slider to be retained thereon.

2. The reclosable bag of claim 1 and wherein:

the separator has a length of 2.3 mm ±0.3 mm.

3. The reclosable of claim 1 and wherein:

the separator with the arrowhead-shaped tip in the triangular shape is integral with the slider and is made of one integral homogenous unit of plastic.

4. The reclosable bag of claim 1 and wherein:

the slider has first and second travel-end stop positions on the strips, the first stop position being the bag-closed stop position, and the second being the bag-opened stop position.

5. The reclosable bag of claim 1 wherein the proximal and distal ends of each of said fastener strips are ultrasonically sealed to each other and to said bag walls proximate the lateral edge of said bag.

6. The reclosable bag of claim 1 wherein said slider has a pair of inwardly facing channels so as to form a slot for slidable reception of and contact with said substantially rectangular flanges and for retention of said substantially rectangular flanges within said slot.

7. The reclosable bag of claim 6 wherein said channel includes oppositely disposed inwardly facing shoulder members having a gap therebetween, said shoulder members being disposed on the bottom of said slides.

8. The reclosable bag of claim 7 wherein said shoulder members each have a beveled surface positioned to guide said fastener into said gap.

9. A bag closure assembly comprising:

first and second elongate flexible strips securable to marginal portions of a bag opening, on first and second walls of the bag, adjacent the top of the walls, one of the strips having a profile portion forming a groove and the other strip having a profile portion forming a rib with a portion received and retained in the groove to hold the strips together, each of the strips having an upper edge adjacent the upper edge of the other strip;

a slider mounted on the strips and movable in one direction longitudinally of the strips to progressively separate the rib from the groove to separate the strips, and the slider being movable in the opposite direction to progressively return the rib portion to retained condition in the groove to join the strips;

a separator situated in the slider and having a proximal portion attached to the slider and having a distal portion residing in the groove; the slider being integral with the separator and is made of one integral homogeneous unit of plastic, and a pair of substantially rectangular flanges are turned outwardly from the first and second walls of the bag disposed parallel to said wall and substantially spaced apart from said top of the wall and below the elongate flexible strips, said substantially rectangular flanges being operatively associated with the slider allowing it to be retained thereon.

10. The bag closure assembly of claim 9 wherein:

the separator has a point at its distal end for entering between the touching edges of the strips and pivoting downward to separate the rib from the groove when the slider is moved in the one direction, thereby wedging the strips apart.

11. The bag closure assembly of claim 10 wherein:

the point is formed by sides of the separator; and the slider has interior walls that converge to squeeze the strips together when the slider is moved in said opposite direction; and the point and the walls converge in the said one direction.

12. In a reclosable bag having first and second walls and an open top defined by first and second elongate flexible fastener strips attached to the first and second walls, respectively, adjacent the top of the walls, one of the fastener strips having a profile portion forming a groove and the other fastener strip having a profile portion forming a rib with a portion of the rib received and retained in the groove when the bag top is closed, each of the fastener strips having a base connected to the respective wall, and each of the strips having an upper edge adjacent the upper edge of the other strip, and the bag having a slider mounted on the fastener strips and movable in one direction longitudinally of the fastener strips to progressively separate the rib from the groove to open the bag, and the slider being movable in the opposite direction to progressively return the rib portion to a retained condition in the groove to close the bag, comprising:

each of the walls has a substantially rectangular flange extending outwardly from the wall and running parallel to and substantially spaced apart from the said top of the walls thereof and below the elongate flexible strips, said substantially rectangular flanges being constructed and arranged to retain said slider thereon, the slider having a pair of inwardly facing channels so as to form a slot for slidable reception of and contact with said substantially rectangular flanges and for retention of said substantially rectangular flanges within said slot, the channels oppositely disposed inwardly facing shoulder members having a gap therebetween, said shoulder members disposed on said bottom of said channel.

13. The reclosable bag of claim 12 and wherein:

the slider has first and second travel-end stop positions on the strips, the first stop position being the bag-closed stop position, and the second stop position being the bag-opened stop position.

* * * * *

UNITED STATES PATENT AND TRADEMARK OFFICE

CERTIFICATE OF CORRECTION

PATENT NO. : 8,096,022 B2
APPLICATION NO. : 11/263607
DATED : January 17, 2012
INVENTOR(S) : Jonathan Hui It is certified that error appears in the above-identified patent and that said Letters Patent is hereby corrected as shown below:

On the Title page in line 4 of the Abstract, "strip" should be changed to --strips--.

Column 2, line 19, "explain" should be changed to --explains--; line 20 "illustrate" should be changed to --illustrates--.

Column 3, line 43, the bold font of "5" should be removed and changed to --5-- with a non-bold font.

In claim 2, line 2, "±0.3" should be changed to --± 0.3--.

In claim 3, line 1, after "reclosable" insert --bag--.

Signed and Sealed this
Eighteenth Day of September, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,096,022 B2
APPLICATION NO. : 11/263607
DATED : January 17, 2012
INVENTOR(S) : Jonathan Hui It is certified that error appears in the above-identified patent and that said Letters Patent is hereby corrected as shown below:

On the Title page in line 4 of the Abstract, "strip" should be changed to --strips--.

Column 2, line 19, "explain" should be changed to --explains--; line 20 "illustrate" should be changed to --illustrates--.

Column 3, line 43, the bold font of "5" should be removed and changed to --5-- with a non-bold font.

Column 6, line 14 (claim 2, line 2) "±0.3" should be changed to --± 0.3--.

Column 6, line 15 (claim 3, line 1) after "reclosable" insert --bag--.

This certificate supersedes the Certificate of Correction issued September 18, 2012.

Signed and Sealed this
Ninth Day of October, 2012

David J. Kappos

David J. Kappos
*Director of the United States Patent and Trademark Office*